US009980626B2

(12) United States Patent
Freudenberg et al.

(10) Patent No.: US 9,980,626 B2
(45) Date of Patent: May 29, 2018

(54) SOLID CHEMICAL PRODUCT DISPENSING USING RECYCLED FLUID

(71) Applicant: Ecolab USA Inc., St. Paul, MN (US)

(72) Inventors: Jared R. Freudenberg, St. Louis Park, MN (US); Ryan Jacob Urban, Mahtomedi, MN (US); Thomas C. Rustad, Minneapolis, MN (US)

(73) Assignee: Ecolab USA Inc., St. Paul, MN (US)

( * ) Notice: Subject to any disclaimer, the term of this patent is extended or adjusted under 35 U.S.C. 154(b) by 676 days.

(21) Appl. No.: 14/527,485

(22) Filed: Oct. 29, 2014

(65) Prior Publication Data

US 2016/0120391 A1 May 5, 2016

(51) Int. Cl.
*A47L 15/44* (2006.01)
*D06F 39/02* (2006.01)

(52) U.S. Cl.
CPC ..... *A47L 15/449* (2013.01); *A47L 15/4436* (2013.01); *A47L 2401/023* (2013.01); *A47L 2401/30* (2013.01); *A47L 2401/34* (2013.01); *A47L 2501/03* (2013.01); *A47L 2501/07* (2013.01)

(58) Field of Classification Search
CPC ..... A47L 15/449; A47L 15/4436; A47L 2401/30; A47L 2401/34; A47L 2501/03; A47L 2501/07; A47L 2401/023
See application file for complete search history.

(56) References Cited

U.S. PATENT DOCUMENTS 3,200,835 A * 8/1965 Farison ..... A47L 15/4436 137/268
3,340,888 A * 9/1967 Farison ..... A47L 15/4427 137/268
4,509,543 A 4/1985 Livingston et al.
(Continued)

FOREIGN PATENT DOCUMENTS

EP 0467028 A1 1/1992
WO 2013087100 A1 6/2013

OTHER PUBLICATIONS

International Search Report and Written Opinion of counterpart International Application No. PCT/US2015/057300, dated Jan. 13, 2016. 17 pp.

(Continued)

*Primary Examiner* — Michael Barr
*Assistant Examiner* — Benjamin L Osterhout
(74) *Attorney, Agent, or Firm* — Shumaker & Sieffert, P.A.

(57) ABSTRACT

Dispensing techniques utilize existing fluid to dispense a solid block of chemical product concentrate. The solid chemical product concentrate may include, for example, detergents, disinfectants, sanitizers, rinse agents, or other cleaning agents. The dispenser monitors and controls the concentration of the chemical product in a use solution. When the concentration of the use solution falls outside of a target range, the dispenser routes existing fluid from within the system to the dispenser, where it interacts with and dispense a solid chemical product concentrate, thus raising (Continued)

the concentration of the chemical product in the use solution. In a dishmachine application, the existing fluid may include post wash or rinse fluid from the dishmachine, or may include use solution from a sump, tank, or other use solution storage container.

18 Claims, 9 Drawing Sheets

(56) References Cited

U.S. PATENT DOCUMENTS 4,687,121 A * 8/1987 Copeland ..... A47L 15/4436 134/93
4,690,305 A * 9/1987 Copeland ..... A47L 15/4436 222/189.06
4,826,661 A * 5/1989 Copeland ..... A47L 15/4436 134/93
4,836,229 A * 6/1989 Lakhan ..... A47L 15/0081 134/103.1
4,845,965 A * 7/1989 Copeland ..... D06F 39/022 134/93
4,938,240 A * 7/1990 Lakhan ..... A47L 15/0081 134/104.4
4,999,124 A * 3/1991 Copeland ..... B01F 1/0027 222/189.06
5,137,694 A * 8/1992 Copeland ..... A47L 15/4436 134/56 D
7,201,290 B2 4/2007 Mehus et al.
7,891,523 B2 2/2011 Mehus et al.
7,896,198 B2 3/2011 Mehus et al.
2003/0168085 A1* 9/2003 Sowle ..... A47L 15/4436 134/25.2
2005/0224099 A1* 10/2005 Luckman ..... B08B 3/02 134/41
2009/0049872 A1 2/2009 Noro et al.
2013/0074942 A1* 3/2013 Stingl ..... A47L 15/4436 137/4
2013/0216450 A1 8/2013 Carroll et al.
2014/0069465 A1 3/2014 Slabbekoorn et al.
2014/0233346 A1 8/2014 Schultz et al.

OTHER PUBLICATIONS

International Preliminary Report on Patentability from corresponding International Application No. PCT/US2015/057300, dated May 11, 2017, 14 pp.

* cited by examiner

SOLID CHEMICAL PRODUCT DISPENSING USING RECYCLED FLUID

BACKGROUND

A dishmachine is a utility dishwasher used in many restaurants, healthcare facilities, and other locations to clean and sanitize cooking and eating articles, such as dishes, pots, pans, utensils and other cooking equipment. Articles are placed on a rack and provided to a wash chamber of the dishmachine. In the chamber, cleaning products and/or rinse agents are applied to the articles during a cleaning process. The cleaning process may include one or more wash phases and one or more rinse phases. At the end of the cleaning process, the rack is removed from the wash chamber so that other racks carrying other articles to be cleaned may be moved into the wash chamber. The cleaning process is then repeated for each of these subsequent racks.

Dishmachines that clean and disinfect dishes in industrial settings often consume large amounts of energy and resources to ensure the dishes are cleaned and sanitized to predetermined standards. However, demand for more energy-efficient products that offer savings on energy and other utility bills, without sacrificing performance or features, has been increasing.

SUMMARY

In general, the disclosure is related to chemical product dispensing that includes one or more features directed to water or energy savings. To reduce fresh water consumption, for example, existing fluid from within a cleaning system is recycled and utilized to dispense a chemical product from a solid chemical product concentrate.

In one example, the disclosure is directed to a system comprising a chemical product dispenser having a housing sized to receive a chemical product in the form of a solid chemical product concentrate, the housing further including an inlet by which recycled fluid from a cleaning apparatus enters the housing and an outlet by which a dispensed solution, formed by contact of the recycled fluid with the solid chemical product concentrate, exits the housing and is directed to a sump containing a use solution, a fluid directing device, and a controller that determines the concentration of the chemical product in the use solution and electronically controls the fluid directing device to direct the recycled fluid from the cleaning apparatus to the sump if the concentration of the chemical product in the use solution satisfies a target concentration, and to direct the recycled fluid from the cleaning apparatus to the inlet of the dispenser if the concentration of the chemical product in the use solution does not satisfy the target concentration, such that the recycled fluid contacts the solid chemical product concentrate to form the dispensed solution, the dispensed solution exits the housing and is directed to the sump to increase the concentration of the chemical product in the use solution.

In another example, the disclosure is directed to a system, comprising a dishmachine that receives articles to be washed during a cleaning process, a sump positioned to capture and hold a use solution comprised of a fluid and a dispensed chemical product, a sensor that monitors a concentration of the chemical product in the use solution, a fluid directing device connected to receive recycled fluid from the washing apparatus during the cleaning cycle, a chemical product dispenser sized to receive a solid chemical product concentrate, wherein the chemical product dispenser dispenses the chemical product into the use solution by applying the recycled fluid from the washing apparatus to the solid chemical product, a dispenser controller that compares the monitored concentration of the chemical product in the use solution with a target concentration, wherein the controller further electronically controls the fluid directing device to direct the recycled fluid into the use solution if the monitored concentration of the chemical product in the use solution satisfies the target concentration, and to direct the recycled fluid from the dishmachine to the dispenser if the monitored concentration of the chemical product in the use solution does not satisfy the target concentration.

In another example, the disclosure is directed to a system comprising a chemical product dispenser having a housing sized to receive a chemical product in the form of a solid chemical product concentrate, the housing further including an inlet by which recycled fluid from within the system enters the housing and an outlet by which a dispensed solution, formed by contact of the recycled fluid with the solid chemical product concentrate, exits the housing and is directed to a sump containing a use solution, a fluid directing device, and a controller that determines the concentration of the chemical product in the use solution and electronically controls the fluid directing device to direct the recycled fluid to the sump if the concentration of the chemical product in the use solution satisfies a target concentration, and to direct the recycled fluid f to the inlet of the dispenser if the concentration of the chemical product in the use solution does not satisfy the target concentration, such that the recycled fluid contacts the solid chemical product concentrate to form the dispensed solution, the dispensed solution exits the housing and is directed to the sump to increase the concentration of the chemical product in the use solution.

The details of one or more examples are set forth in the accompanying drawings and the description below. Other features will be apparent from the description and drawings, and from the claims.

DETAILED DESCRIPTION

Figure 1:
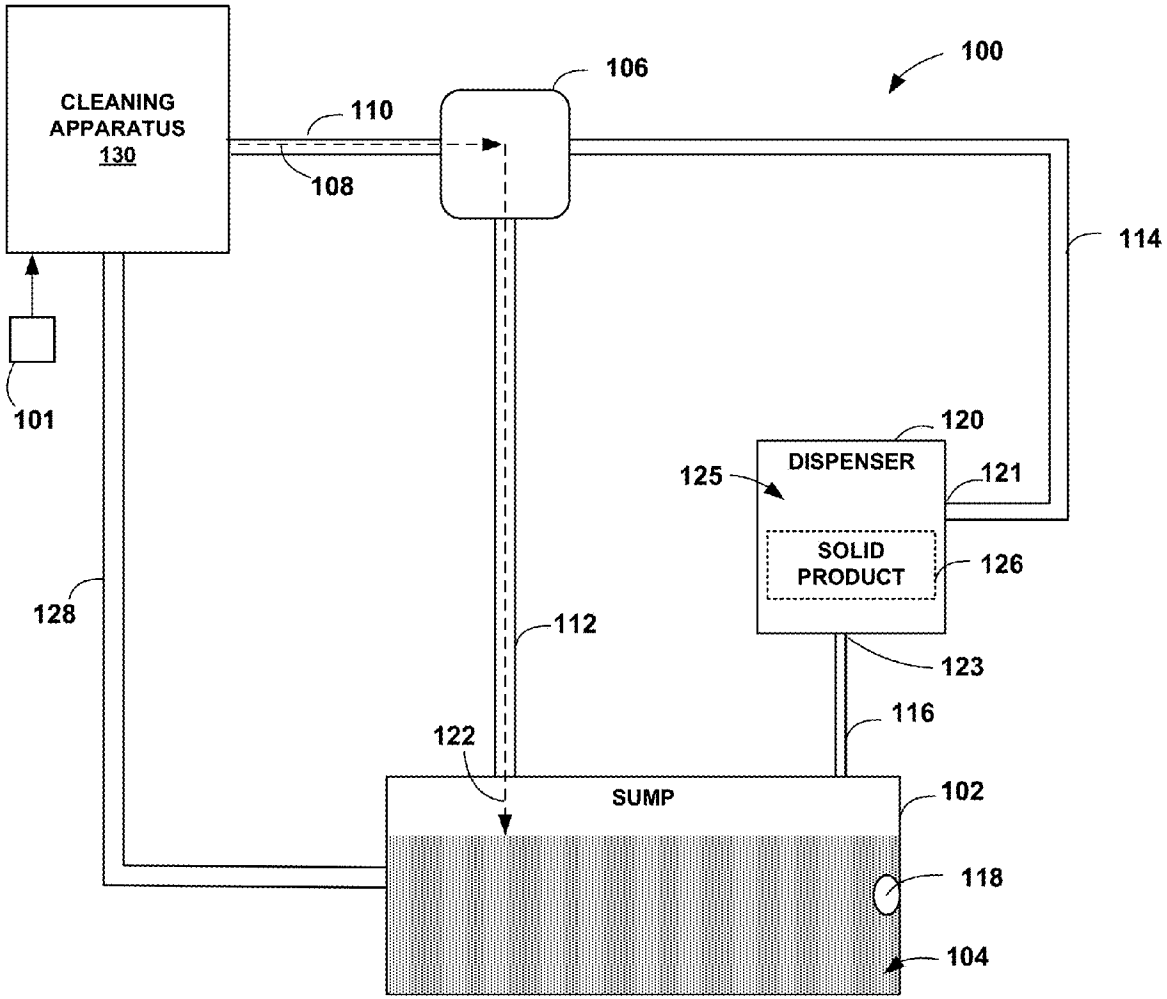
FIGS. 1 and 2 are diagrams illustrating an example system for dispensing a solid chemical product using existing fluid in a cleaning application.

High efficiency commercial dishwashers (such as ENERGY STAR certified dishwashers) use various techniques to clean dishes while using less water and energy than their conventional counterparts. The amount (volume, typically measured in gallons per rack) of water consumed by a commercial dishwasher during a cycle is one factor that affects the energy and water efficiency of a dishwasher. High efficiency laundry equipment, as well as other types of cleaning equipment, are similarly concerned with reducing water and energy usage. The present disclosure describes dispensing systems and methods that recycle existing fluid (i.e., fluid that is already existing in the system rather than fresh water) to dispense a chemical product from a solid chemical product concentrate. The recycled existing fluid is used to dispense a solid chemical product concentrate to create a use solution having a desired concentration of a chemical product. The solid chemical product concentrate may include, for example, detergents, disinfectants, sanitizers, rinse agents, or other cleaning agents. The solid chemical product concentrate may also include any other chemical product that is dispensed by contact of a fluid with a solid chemical product concentrate, and in which it is appropriate to recycle existing system fluid to dispense the chemical product.

In one example, a solid chemical product concentrate is housed in a dispenser. Recycled existing system fluid (e.g., wash or rinse fluid from a cleaning apparatus, use solution from a sump or tank within the system, or other recycled system fluid) is introduced into the housing of the dispenser to interact with the solid chemical product concentrate to form a dispensed solution. When the recycled fluid comes into contact with the solid chemical product concentrate, the recycled fluid erodes and/or dissolves the solid product to form the dispensed solution. The dispensed solution is then directed to a use solution sump or other container to increase the concentration of the chemical product in the use solution.

To control the amount of chemical product in the dispensed solution, and/or the rate at which the chemical product solution is dispensed, certain variables may be controlled and adjusted either manually or automatically to account for certain characteristics of the solid product and/or the recycled fluid. The variables that may be adjusted may include, for example, the amount (volume) of the recycled fluid that comes into contact with the solid product, the flow rate of the recycled fluid as it contacts the solid product, the amount of time that the recycled fluid is in contact with the solid product, the turbulence of the recycled fluid as it contacts the solid product, or any other variable that may affect dispensation of the chemical product. Characteristics that may affect adjustment of these variables may include, for example, the temperature of the recycled fluid, the chemistry of the solid product, the density of the solid product, the shape of the solid product, or the climate of the location of the solid product or dispenser, or any other characteristic that may affect dispensation of the chemical product. The dispensed solution may be directed to sump or other storage container for later dispensation to an end use application, or it may be sent directly to the end use application or apparatus for immediate use.

Figure 2:
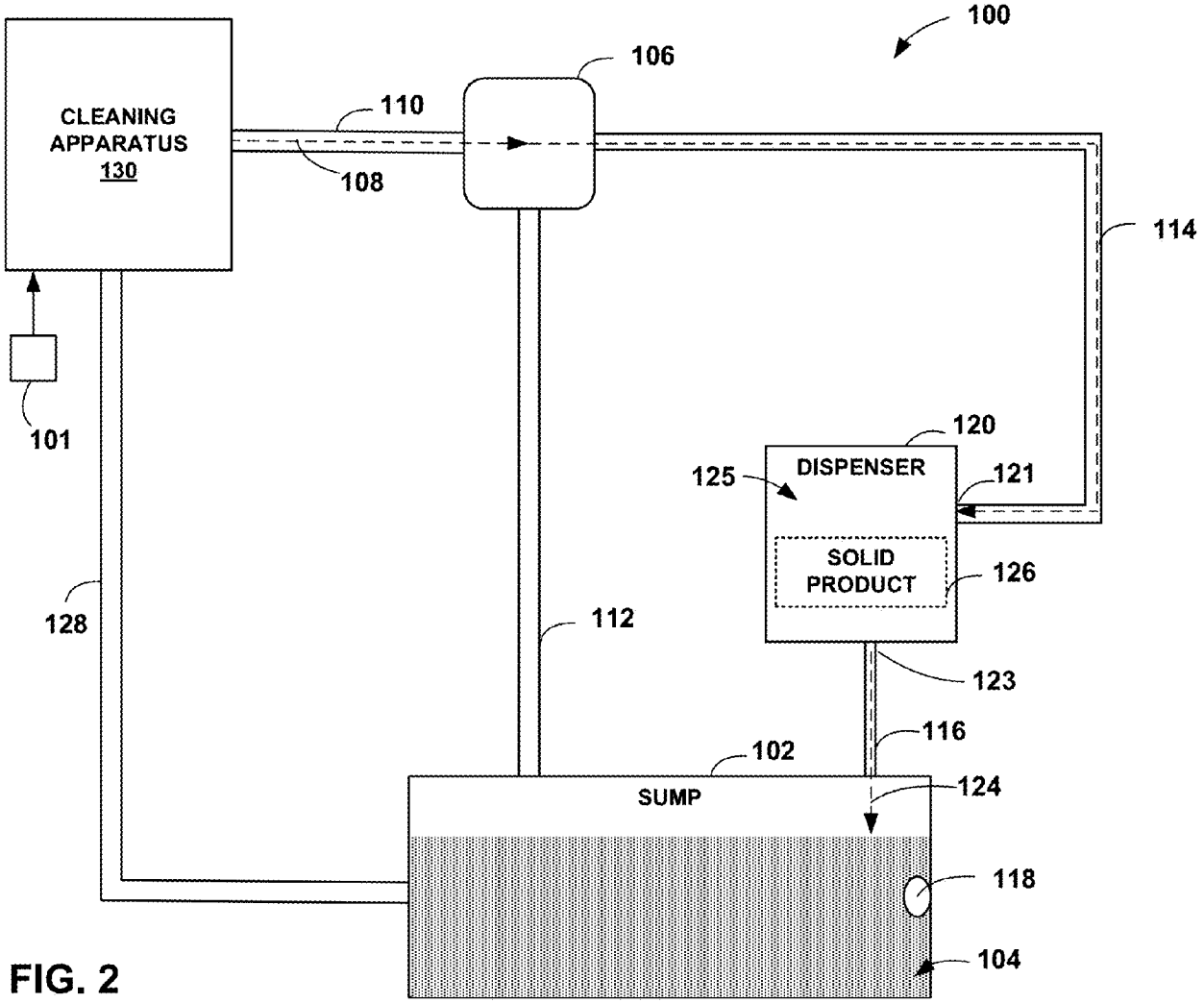

FIGS. 1 and 2 are diagrams illustrating an example system 100 that dispenses a chemical product from a solid chemical product concentrate 126 using recycled existing system fluid. A cleaning apparatus 130 draws a use solution 104 from a sump 102 via fluid conduit 128 and applies the use solution 104 to the articles or equipment to be cleaned during a cleaning cycle. Use solution 104 has a target concentration for a chemical product. In a cleaning application, such as a dishmachine, laundry machine, food service equipment, etc., the target concentration of the use solution is desired to ensure effective cleaning, disinfecting, and/or sanitizing of the articles or equipment being cleaned.

In one example, cleaning apparatus 130 is a commercial dishmachine, such as that used to clean dishes, glassware, utensils, pots and pans, and other kitchen objects in restaurants, cafeterias, bakeries, health care facilities, and other commercial food service industries. A typical commercial dishmachine 130 includes a housing 110 defining one or more wash chambers. The articles washed by dishmachine 130 may be automatically or manually moved through the dishmachine 130 on article racks. Dishmachine 130 cleans the articles by spraying a mixture of hot water and one or more cleaning products onto the dishes. The cleaning solution is pumped to one or more rotating spray arms, which blasts the dishes with the cleaning mixture. Dishmachine 130 is provided with a source of fresh water 101 and also includes one or more sumps may hold used wash and/or rinse fluid to be reused in the next cleaning cycle. In other examples, source 101 may also be a rinse water reservoir or sump, from which rinse water from a previous cycle may be re-used. Once the wash cycle is finished, a rinse cycle begins. Depending upon the machine, the articles to be cleaned, the amount of soil on the dishes, and other factors, one or more wash cycles may be interspersed with one or more rinse cycles to form one complete dishmachine cleaning cycle.

A chemical product dispenser 120 includes a housing sized to receive a solid block of a chemical product concentrate 126 that is dispensed under control of system 100 to form a use solution 104 having a concentration of the chemical product that satisfies a minimum target or falls within a target range. The dispenser housing further includes an inlet 121 by which a fluid may enter the housing and an outlet 123 by which a dispensed solution, created by contact of the fluid with the solid chemical product concentrate, may exit the housing. Inlet 121 and outlet 123 may be positioned on any side of the dispenser housing. For example inlet 121 may be positioned on the top, bottom, or sides of the dispenser housing. Likewise, outlet 123 may be positioned on the top, bottom, or sides of the dispenser housing.

A concentration sensor 118 monitors concentration data indicative of the concentration of the chemical product in use solution 104. For example, concentration sensor 118 may include a conductivity probe that measures the conductivity of use solution 104, which may be indicative of the concentration of the chemical product in the use solution. As another example, concentration sensor 118 may include a pH sensor that measures the pH of use solution 104, which may be indicative of the concentration on of the chemical product in the use solution. Sensor 118 communicates with a dispenser controller (not shown in FIGS. 1 and 2), which receives the concentration data from sensor 118 and determines the concentration of the chemical product in use solution 104.

In the example of FIG. 1, existing fluid, such as post wash or post rinse fluid 108 from cleaning apparatus 130, is recycled and directed through a fluid delivery conduit 110 to a fluid directing device 106. If the concentration of use solution 104 satisfies the target concentration, device 106 directs the recycled post wash or rinse fluid 108 through fluid delivery conduit 112 directly into sump 102, as indicated by reference numeral 122.

As shown in FIG. 2, when concentration sensor 118 detects that the concentration of the solid product in the use solution 104 does not satisfy the target concentration, system 100 triggers the device 106 to divert the recycled post wash or post rinse fluid flow through fluid delivery conduit 114 to chemical product dispenser 120. Within dispenser 120, the recycled fluid diverted from the cleaning apparatus 130 contacts with the solid chemical product concentrate, and dissolves/erodes the solid to form a dispensed solution 124 that exits dispenser 120 via outlet 123 and is directed into sump 102 via fluid conduit 116. When concentration sensor 118 determines that the concentration of the use solution 104 satisfies the target concentration, system 100 triggers diverter 106 to redirect the recycled fluid from the cleaning apparatus 130 to flow directly into sump 102 via fluid conduit 112 (FIG. 1). In this way, system 100 may automatically control the concentration of use solution 104 within sump 102 using recycled existing fluid. Water efficiency for each dishmachine cycle may thus be increased because no fresh water is introduced into the system for the purpose of chemical product dispensing. This may result in reduced energy and water usage, which may further lead to cost savings. In addition, the temperature of post rinse water in many applications is controlled due to sanitization requirements. Therefore, the system may have a consistent temperature source to promote consistent dispensing and/or erosion of the solid block of chemistry.

Figure 3:
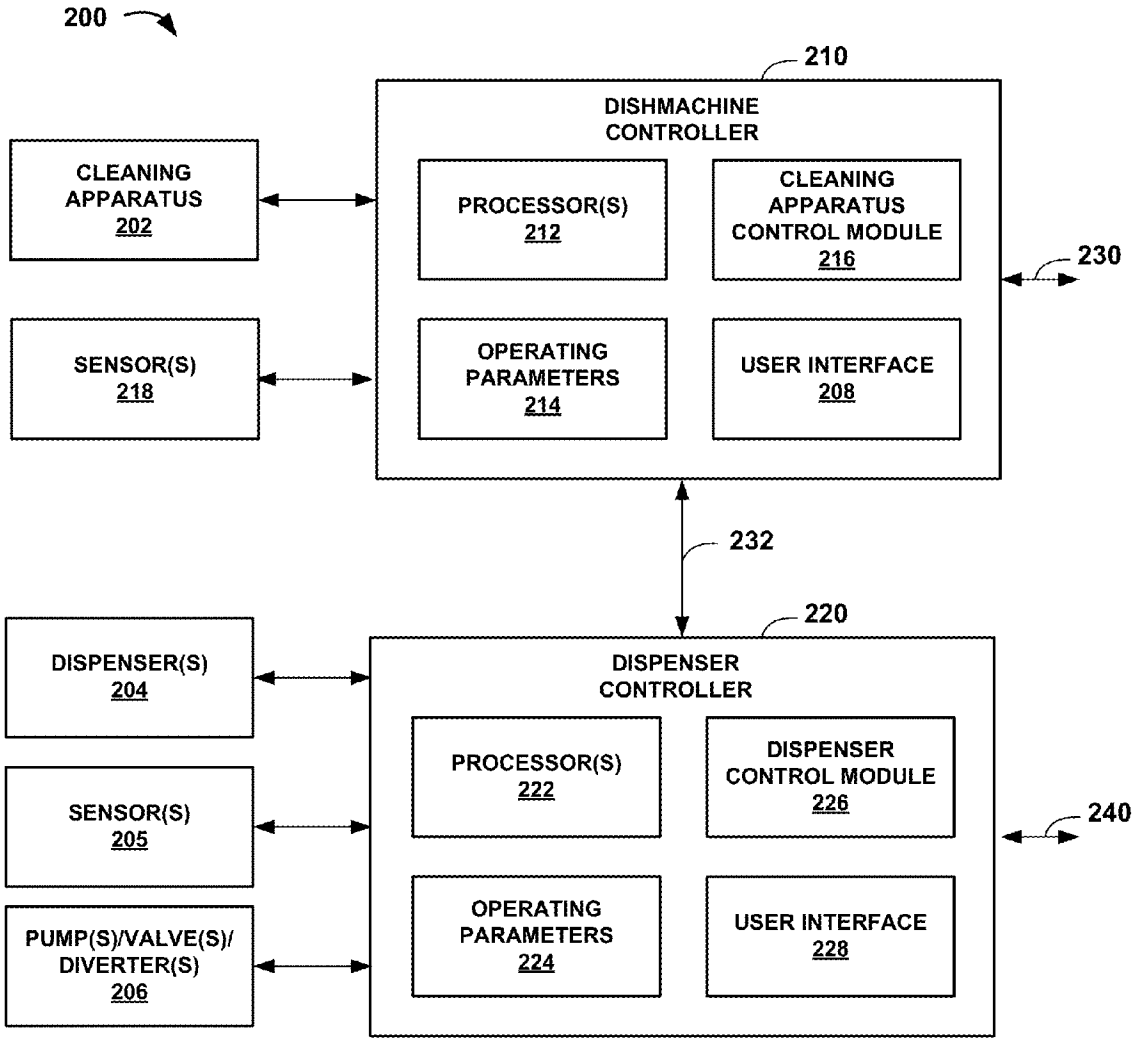
FIG. 3 is a block diagram illustrating electronic components of an example dispensing system that uses existing fluid to dispense one or more chemical products in a cleaning application.

FIG. 3 is a block diagram illustrating an example implementation of the electronic control components 200 of dispensing system that uses recycled existing fluid to dispense one or more chemical products in a cleaning application. System 200 includes a cleaning apparatus controller 210 and a dispenser controller 220. In this example, cleaning apparatus controller 210 monitors and controls operation of a cleaning apparatus 202. Dispenser controller 220 monitors and controls concentration of the chemical product in a use solution using recycled existing fluid, and also controls dispensation of the one or more chemical products to cleaning apparatus 202. Cleaning apparatus controller 210 and dispenser controller 220 may communicate via a wired or wireless communication link 232.

Cleaning apparatus controller 210 includes one or more processor(s) 212 and computer readable media that store, for example, a cleaning apparatus control module 216 and operating parameters 214. Control module 216 includes appropriate programmed software or firmware modules that, when executed by processor(s) 212, control and monitor operation of cleaning apparatus 202 as specified by the operating parameters 214. Operating parameters 214 may include, for example, wash water temperature, rinse water temperature, timing of wash and rinse cycles, duration of wash and rinse cycles, etc. One or more sensors 218 permit controller 210 to monitor real-time operating parameters of the cleaning apparatus, such as the current temperatures, start/stop of wash or rinse cycles, door open/closed, etc. A user interface 208 may permit an operator to input commands or into the cleaning apparatus such as start/stop, select a type of cycle, adjust operating parameters, or view the status of one or more operating parameters, view instructional videos, etc. User interface 208 may also include various audible and/or visual alarms. Controller 210 may further include a communication link 230 through which controller 210 may send data or receive instructions to/from one or more remote servers or computing devices.

During operation, controller 210 may monitor and control the timing of the wash and/or rinse phases, the duration of the wash and/or rinse phases, the temperature of the fluid applied during the wash and/or rinse phases, the times at which chemical products and/or water are dispensed into wash chamber, operation of one or more wash arms or other mechanism through which water and/or chemical product(s) are dispensed, operation of a conveyor, and/or any other processes in the cleaning apparatus that may be electronically controlled.

A dispenser controller 220 may control operation of one or more chemical product dispenser(s) 204, such as dispenser 120 in FIGS. 1 and 2. Although in this example cleaning apparatus controller 210 and dispenser controller 220 are implemented using separate hardware, it shall be understood that the functions performed by the cleaning apparatus and dispenser controllers may be incorporated into a single controller. Dispenser controller 220 may monitor and control the concentration of chemical product in the use solution, control dispensation of chemical product to maintain the concentration of the chemical product the use solution, etc.

In some examples, dispenser controller 220 controls operation of a single dispenser 204 that dispenses one type of chemical product. In other examples, dispenser controller 220 may control a plurality of chemical product dispensers 204, each of which dispense a different one of a plurality of solid chemical product concentrates. For example, dispensers 204 may include, for example, a detergent dispenser that dispenses a detergent solution using recycled existing fluid, a sanitizer dispenser that dispenses a sanitizing solution using recycled existing fluid, a disinfectant dispenser that dispenses a disinfecting solution from a solid disinfectant concentrate using recycled existing fluid, a rinse aid dispenser that dispenses a rinse aid solution using recycled existing fluid, etc.

As mentioned above, cleaning apparatus controller 210 and dispenser controller 220 may communicate via a wired or wireless communication link 232 to coordinate chemical product dispensing during a cleaning cycle. For example, in response to initiation of a wash phase of the cleaning apparatus 202, controller 210 may communicate with dispenser controller 220 to initiate dispensing of chemical product(s) used during the wash phase(s). Similarly, in response to initiation of a rinse phase of the cleaning apparatus 202, controller 210 may communicate with dispenser controller 220 to control dispensing of any chemical product(s) used during the rinse phase(s).

Dispenser controller 220 includes one or more processor(s) 222 and computer readable media that store, for example, a dispenser control module 226 and dispenser operating parameters 224. Dispenser control module 226 includes appropriate programmed software or firmware modules that, when executed by processor(s) 222, control and monitor operation of one or more dispensers 204 as specified by the dispenser operating parameters 224. Dispenser operating parameters 224 may include, for example, one or more fixed and/or variable operating parameters relevant to dispensation of the chemical product from the solid chemical product concentrate. Dispenser operating parameters 224 may include, for example, target concentrations of one or more chemical products, fluid flow rates in the dispenser, the temperature of the fluid, the turbulence of a fluid as it contacts the solid product concentrate, the spray pattern or geometry of the fluid as it contacts the solid product concentrate, the distance between a source of the fluid and the solid product concentrate, the amount of fluid contacting the solid product concentrate, the amount of time the fluid is applied to the solid product concentrate, or any other parameter that may affect dispensing of the chemical product. The operating parameters may also include fixed characteristics that may affect the variable operating parameters. These fixed characteristics may include the chemistry of the solid product concentrate, the density of the solid product concentrate, the form of the solid product concentrate (i.e., block, tablets, pellets, etc.), the shape of the solid product concentrate, the climate of the location of the solid product or dispenser, and other characteristics.

One or more sensors 205 permit dispenser controller 220 to monitor real-time operating parameters of the dispenser, such as the concentration of the chemical product in the use solution, the flow rate of the recycled fluid as it is applied to the solid product, the temperature of the recycled fluid as it is applied to the solid product, the amount of recycled fluid applied to the solid product, the amount of time the recycled fluid is applied to the solid product, or any other relevant operating parameter. A user interface 228 may permit an operator to input commands to the cleaning apparatus such as commands to manually start/stop dispensing, adjust operating parameters, view the status of one or more operating parameters, view instructional videos, etc. User interface 228 may also include various audible and/or visual alarms or indicators, such as cycle indicators (wash/rinse/cycle complete), out of product indicators, timers, etc. Dispenser controller 220 may further include a communication link 240 through which dispenser controller 220 may send data or receive instructions to/from one or more remote servers or computing devices.

During operation, controller 220 may monitor and control the concentration of the chemical product in the use solution using recycled existing fluid to form a use solution from a solid chemical product concentrate. For example, dispenser controller 220 may receive concentration data from a concentration sensor, such as concentration sensor 118 as shown in FIG. 1, indicative of the concentration of the chemical product in the use solution. Dispenser controller 220 receives the concentration data and determines the concentration of the chemical product in the use solution. Controller 220 may compare the monitored concentration of the chemical product in the use solution with a target concentration and determine whether additional chemical product should be added to the use solution based on the comparison. One or more pumps, valves, diverters or other fluid directing device(s) 206 electronically controllable by the controller may direct existing fluid from dishmachine 202 to a sump (or other use solution container) if the monitored concentration of the chemical product in the use solution satisfies the target concentration. On the other hand, if the controller 220 determines that the monitored concentration of the chemical product in the use solution does not satisfy the target concentration (as specified, e.g., by the operating parameters 224), controller 220 may cause fluid directing device(s) 206 to direct existing fluid from the cleaning apparatus to the dispenser 204 for purposes of dispensing additional amounts of chemical product into the use solution, thus increasing the concentration of the chemical product of the use solution using recycled existing fluid from the cleaning apparatus.

Alternatively, as described herein below, if the monitored concentration of the use solution does not satisfy the target concentration, dispenser controller 220 may control one or more fluid directing device(s) 206 to direct existing use solution from a sump (or any other existing system fluid or solution) to dispenser 204 for the purpose of dispensing additional amounts of chemical product into the use solution, thus increasing the concentration of the chemical product of the use solution using recycled existing fluid from the cleaning apparatus.

Controller 220 may determine whether the monitored concentration satisfies one or more target threshold concentrations by, for example, comparing the monitored concentration with a target concentration. The target concentration may include a lower limit below which the controller would determine that addition chemical product should be added to the use solution. In other words, if the monitored concentration does not satisfy the target concentration (or if the target concentration is below the target concentration in this example) the controller would cause recycled existing fluid to be directed from the cleaning apparatus to the chemical product dispenser. Alternatively, the controller may determine whether the monitored concentration of the use solution is within a target range.

Dispenser controller 220 may communicate with cleaning apparatus controller 210 via communication link 232 to determine the timing of the wash and/or rinse phases, the duration of the wash and/or rinse phases, the temperature of the water applied during the wash and/or rinse phases, the times at which chemical products and/or water are dispensed, and/or any other parameters sensed or controlled by the dishmachine that may be relevant to dispensation of the one or more chemical products.

In the example of FIGS. 1 and 2, the existing fluid from a cleaning apparatus is recycled, that is, the existing fluid is directed to a chemical product dispenser to dispense a chemical product from a solid chemical product concentrate. In other examples, use solution from a sump, or any other existing fluid in the system may be used to dispense a solid product.

Chemical product dispensers described herein may be implemented using any type of dispenser designed to form a dispensed solution including a chemical product from a solid chemical product concentrate. For example, the chemical product dispenser may spray a fluid onto a solid product to dissolve/erode the solid product and form a dispensed solution. With this technique, the operating parameters may change in part based on certain characteristics within the dispenser, such as the distance between the solid product and the spray nozzle and the change in the pressure and temperature of the fluid being sprayed onto the solid product. Changes in a nozzle's flow rate, spray pattern, spray angle, and nozzle flow can also affect operating parameters, thereby affecting the chemistry, effectiveness, and efficiency of the concentration of the resulting dispensed solution.

Alternatively, the dispenser may form a dispensed solution by immersing all or a portion of the solid chemical product concentrate into a pool of fluid. The dispenser may automatically raise and lower the solid product into and out of the pool of fluid, or the fluid level may be raised and lowered to at least partially contact the solid product. However, similar to spraying, changes in characteristics of the fluid or the environment may affect the dissolve/erosion rate of the product chemistry. For example, the temperature of the fluid and flow rate of the fluid in contact with the solid product are but a few of the parameters that may affect the concentration of the solution and/or the erosion rate of the product.

As another alternative, the dispenser may control the turbulence or the flow scheme of the fluid in contact with the solid product. Examples of variables that may be adjusted to control fluid turbulence may include changing the flow rate, direction, flow path, or spray pattern of the fluid, changing the distance between the fluid source and the solid product, changing the amount of surface area of the solid product being exposed to the fluid (either in a pool, by flooding, or by spray), changing the size, number or geometry of holes associated with the spray, or the like. It should be appreciated that other changes to the turbulence of the fluid may also be made, and that the disclosure is not limited in this respect. The turbulence of the fluid can be adjusted either manually or in real time to aid in maintaining the concentration of the solution created by the recycled fluid and the solid product.

As another alternative, dispensers including mechanical means of eroding a solid block of chemical product may also be used. Thus, it shall be understood that many alternative implementations of a solid product dispenser may be used, and that the disclosure is not limited in this respect.

Example solid product dispensers that may be adapted to dispense solid products using recycled existing system fluid are shown and described in, for example, U.S. Patent Application No. 61/766,774, filed Feb. 20, 2013; U.S. patent application Ser. No. 13/771,351, filed Feb. 20, 2013; U.S. Pat. No. 7,201,290, issued Apr. 10, 2007; U.S. Pat. No. 7,896,198, issued Mar. 1, 2011; and U.S. Pat. No. 7,891,523, issued Feb. 22, 2011, each of which are incorporated herein by reference.

Figure 4:
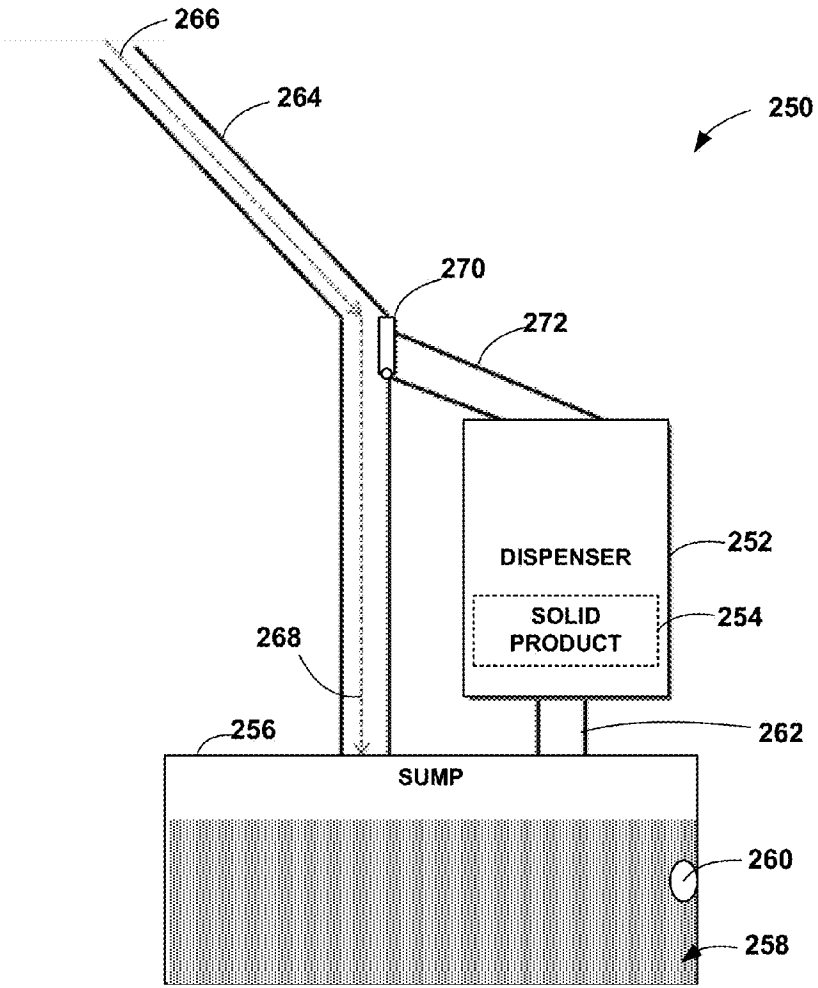
FIGS. 4 and 5 are diagrams illustrating another example system that dispenses a solid chemical product using existing fluid in a dishmachine application.
Figure 5:
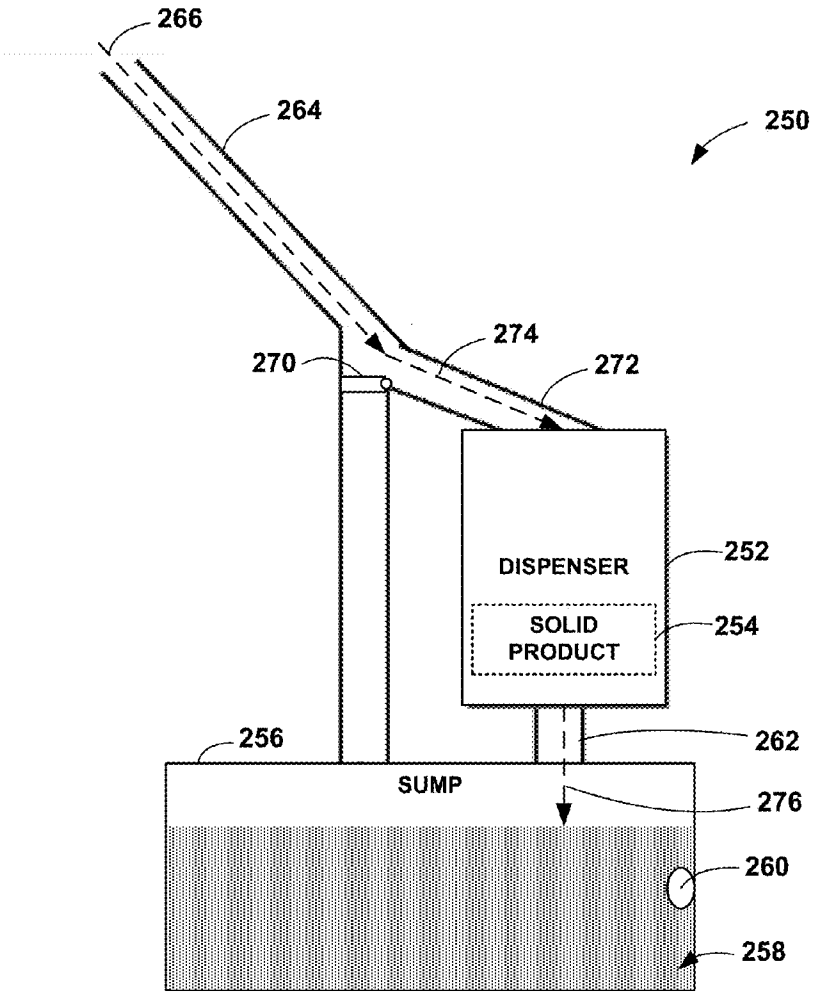

FIGS. 4 and 5 are diagrams illustrating another example system 250 that dispenses a solid chemical product using existing fluid in a cleaning application. System 250 uses a gravity method of creating turbulence to erode a solid block of chemical product 254 housed in a dispenser 252.

A concentration sensor 260 senses concentration data indicative of the concentration of the chemical product in use solution 258. Dispenser 252 further includes a dispenser controller, such as dispenser controller 220 of FIG. 3. As shown in FIG. 4, if the concentration of the use solution is within a target range, dispenser controller controls a fluid directing device 270 to recycle the existing fluid 266 in the cleaning system to a sump 256 (or other fluid container), as indicated by reference numeral 268. If, as shown in FIG. 5, the concentration data monitored by concentration sensor 260 indicates that the concentration of the chemical product does not satisfy the target concentration, dispenser controller may control the fluid directing device 270 to direct the recycled existing fluid from the cleaning application to the dispenser 252, as indicated by reference numeral 274. Flooding of the solid product 254 within the dispenser erodes/dissolves the solid chemical product concentrate to form a dispensed solution including the chemical product, which is then dispensed into sump 258.

Figure 6:
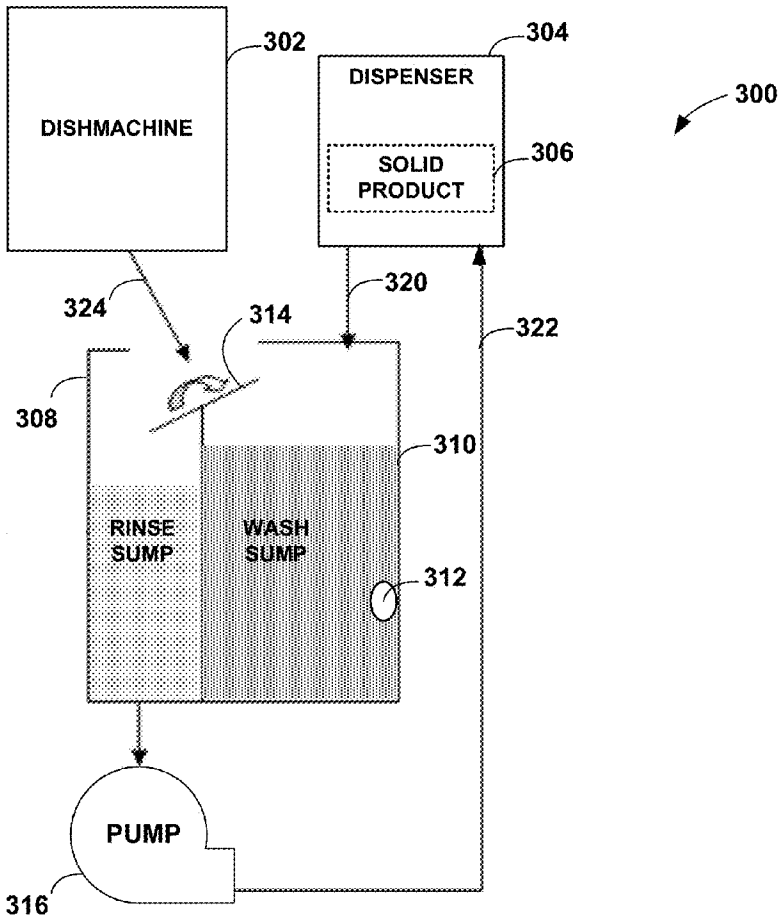
FIG. 6 is a diagram illustrating another example system that dispenses a solid chemical product using existing fluid in a dishmachine application.

FIG. 6 is a diagram illustrating another example system 300 that dispenses a solid chemical product using existing fluid in a dishmachine application. System 300 recycles post rinse or existing wash fluid from a dishmachine 302 to dispense a solid product 306. System 300 also includes electronic control components such as those shown and described above with respect to FIG. 3. System 300 uses a pump 316 to deliver existing fluid from a rinse sump 308 to a dispenser 304 to create turbulence and dissolve/erode solid chemical product concentrate 306. If the concentration data measured by a concentration sensor 312 indicates that the concentration of the chemical product in the wash sump 310 is below a threshold, dispenser controller may control pump 316 to direct existing fluid from rinse sump 308 to dispenser 304. The turbulence of recycled fluid 322 may be controlled to form a dispensed solution 320, which is then directed into wash sump 310, thus increasing the concentration of the solid product in wash sump 310.

In FIG. 6, the recycled post wash or rinse fluid 324 from dishmachine 302 is directed to a diverter plate 314 or other device for directing fluid flow. If the concentration of the use solution satisfies the target, the normal path of the post wash or rinse fluid is directly to the wash sump 310. When the concentration sensor 312 indicates that the concentration of the chemical product in the wash sump 310 is below a target concentration, the diverter 314 triggers to direct fluid to an alternate tank, such as rinse sump 308. A pump 316 then recycles the existing fluid from the rinse sump, as indicated by reference numeral 322, to supply a dispenser to erode or dilute chemistry which is directed into the wash sump. When the concentration sensor 312 indicates that the concentration of the chemical product in the wash sump 310 is within a target range, dispenser controller may cause diverter 314 to move back to its original position directing fluid 324 into wash sump 310.

Figure 7:
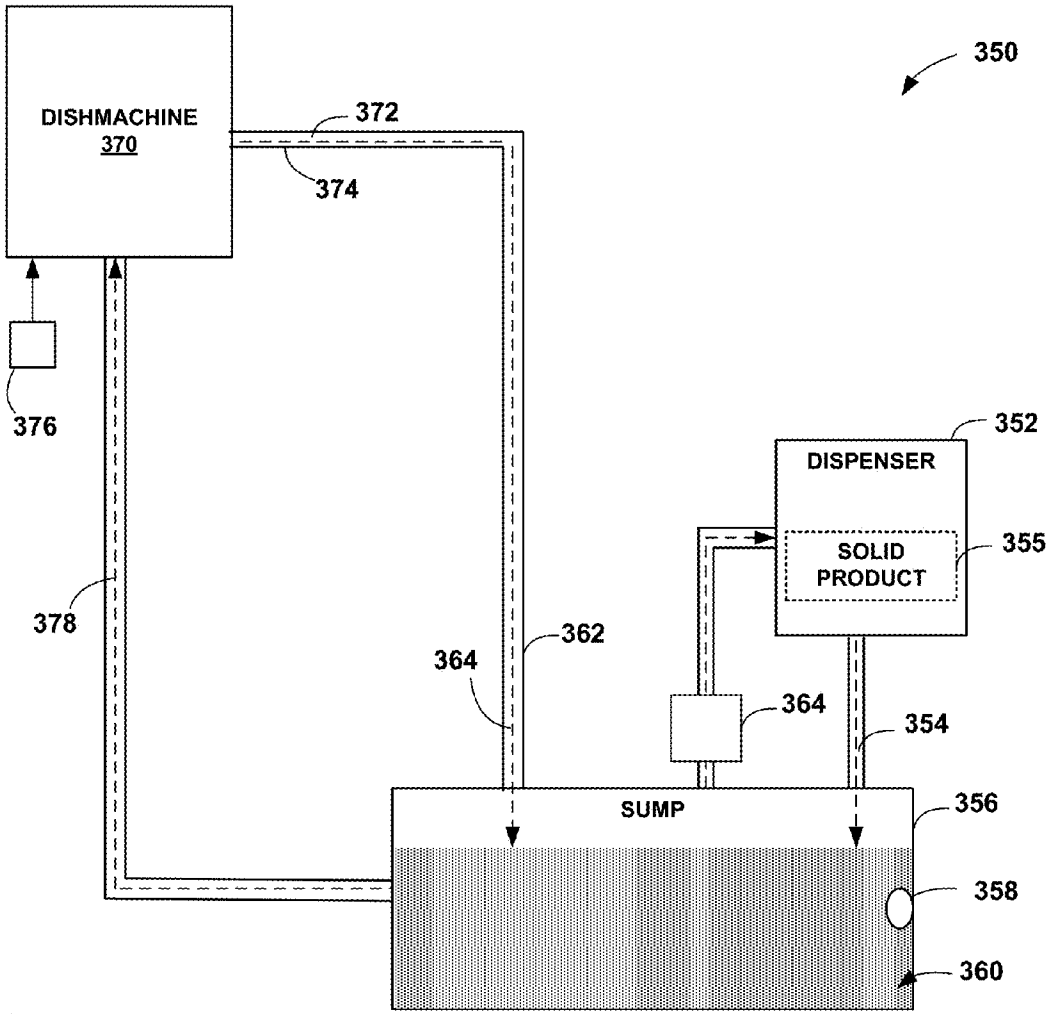
FIG. 7 is a diagram illustrating another example system that dispenses a solid chemical product using existing fluid in a dishmachine application.

FIG. 7 is a diagram illustrating another example system 350 that dispenses a solid chemical product using existing fluid in a dishmachine application. System 350 uses existing use solution, such as use solution 360 from a sump 356, to dispense a solid product 355 contained within a dispenser 352. Such a dispenser 352 may operate using one or more of the gravity, spray, pool, or turbulence control methods described herein, or any other manner of implementing a solid chemical product dispenser.

System 350 also includes electronic control components such as those shown and described above with respect to FIG. 3. In this example, a dishmachine 370 applies a use solution 378 from a sump 356 to articles within the dishmachine during its cleaning cycle. During a cleaning cycle, at least some of the used post wash and/or rinse fluid 372 is returned to the sump 356 via fluid conduit 374. When a concentration sensor 258 indicates that the concentration of the chemical product in use solution 360 a sump 356 does not satisfy a target concentration, existing use solution 360 from sump 356 may be pumped or gravity fed (using a pump/gravity feed/diverter 364) to dispenser 352, where it is applied to the solid chemical product concentrate to form a dispensed solution 254. Dispensed solution 254 is directed into sump 356, thus increasing the concentration of the chemical product in the use solution 360 using existing use solution already present in the system rather than introducing additional fresh water into the system.

Concentration sensors, such as those indicated by reference numerals 118 of FIGS. 1 and 2, 205 of FIG. 3, 260 of FIGS. 4 and 5, 312 of FIG. 6, may be implemented using a variety of techniques for measuring or controlling concentration of an ingredient in a fluid solution. Sensors that directly or indirectly measure concentration may include, for example, a conductivity probe, a pH meter, or an automated titration system. Concentration of a use solution may also be indirectly inferred using time-based dispensing, weight-based dispensing, etc.

Figure 8:
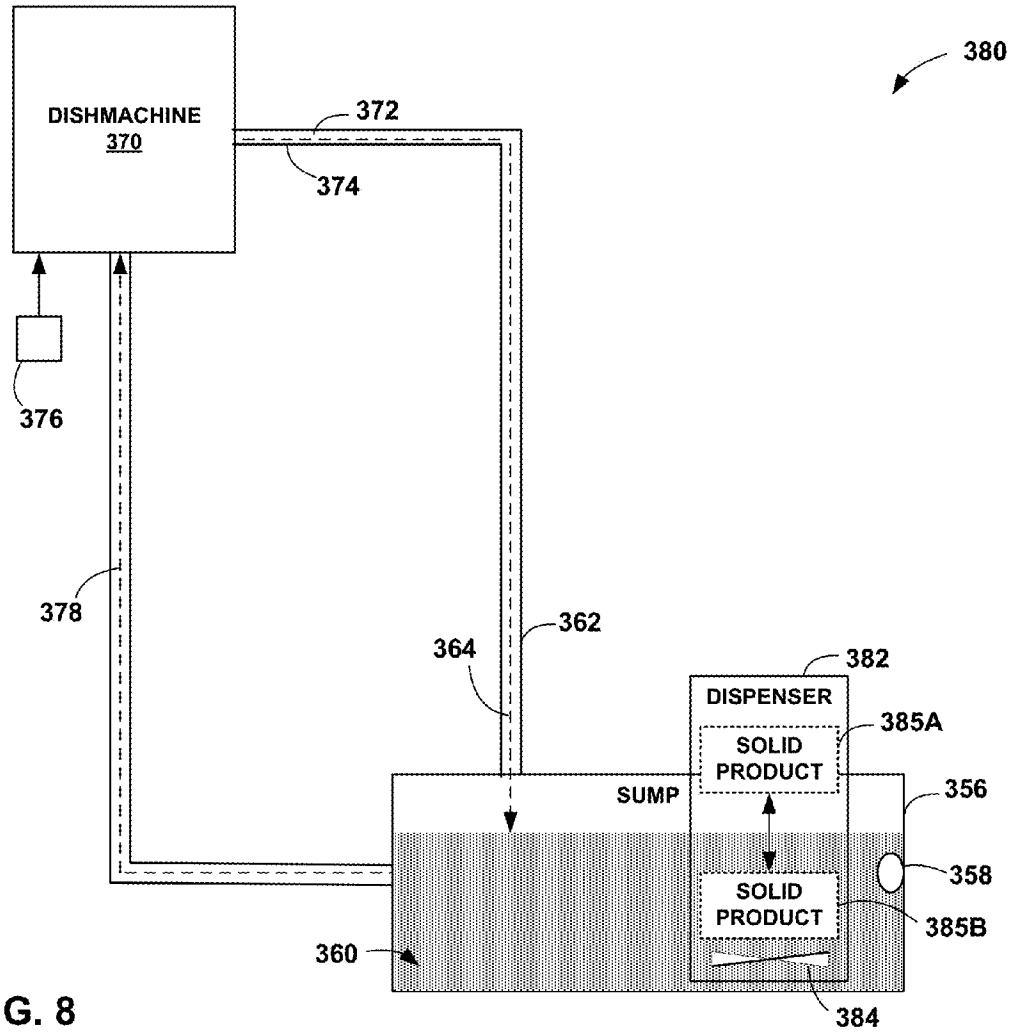
FIG. 8 is a diagram illustrating another example system that dispenses a solid chemical product using existing fluid in a dishmachine application.

FIG. 8 is a diagram illustrating another example system 380 that dispenses a solid chemical product using existing fluid in a dishmachine application. System 380 also includes electronic control components such as those shown and described above with respect to FIG. 3. In this example, a dishmachine 370 applies a use solution 378 from a sump 356 to articles within the dishmachine during its cleaning cycle. During a cleaning cycle, at least some of the used post wash and/or rinse fluid 372 is returned to the sump 356 via fluid conduit 374. A dispenser 382 is configured to move the solid chemical product from a higher, non-dispensing position (indicated by solid product at position 385A) and a lower, dispensing position (indicated by solid product at position 385B). In the non-dispensing position 385A, the solid block of chemical product is raised out of the level of the use solution. Because the solid block of chemical product is not in contact with any dispensing fluid in the non-dispensing position, no chemical product is dispensed into the use solution. In the dispensing position 385B, the solid block of chemical product is completely or partially lowered into the use solution. Contact with the use solution erodes/dissolves the solid block of chemical product, thus increasing the concentration of the chemical product in the use solution. An agitator 384 may stir or mix the use solution to create turbulence, which may increase the rate at which the chemical product is dissolved/eroded. Agitator 384 may be part of dispenser 382 or it may be located in the sump 356.

When concentration sensor 258 indicates that the concentration of the chemical product in use solution 360 does not satisfy a target concentration, dispenser 382 may lower the solid block of chemical product from the non-dispensing position 385A to the dispensing position 385B. When concentration sensor 258 indicates that the concentration of the chemical product in use solution 360 satisfies the target concentration, dispenser 382 may raise the solid block of chemical product from the dispensing position 385B to the non-dispensing position 385A.

In another example, the solid product is supported at a predetermined level within the sump. The use solution level in the sump is raised or lowered depending upon the concentration of the chemical product in the use solution. In this example, a flood gate may be configured to open when the concentration sensor 358 determines that the concentration of the chemical product in use solution 360 does not satisfy a target concentration, thus raising the level of the use solution in the sump to partially or completely immerse the solid product in the use solution. When the concentration sensor 358 determines that the concentration of the chemical product in use solution 360 satisfies the target concentration, the flood gate may reverse the flow, thus lowering the level of the use solution in the sump such that the solid product is no longer in contact with the use solution.

Figure 9:
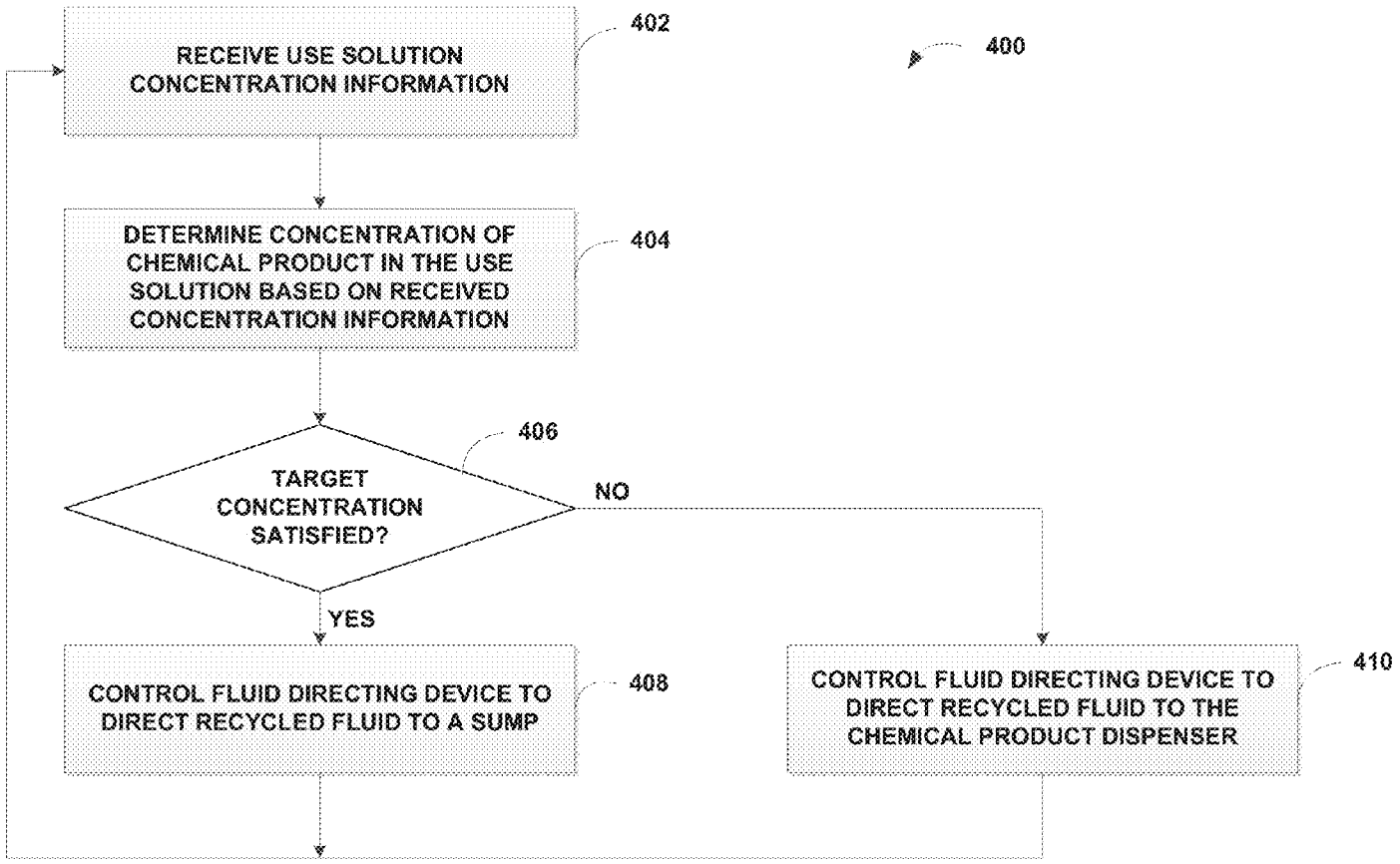
FIG. 9 is a flow diagram illustrating an example process by which a dispenser controller may monitor and control concentration of a use solution using existing/recycled fluid.

FIG. 9 is a flow diagram illustrating an example process (400) by which a dispenser controller may monitor and control concentration of a use solution using existing/recycled fluid in a cleaning apparatus. The dispenser controller receives information concerning the concentration of the use solution (402). For example, the dispenser controller may receive receives concentration information from a sensor, such as one of sensors 118, 218, 260, 312, or 358 described above. The sensor may include, for example, a pH sensor, a conductivity sensor, or any other sensor capable of detecting information associated with the concentration of the chemical product in the use solution. The dispenser controller determines the concentration of the chemical product in use solution based on the received concentration information (404).

The dispenser controller determines whether the concentration of the chemical product in the use solution satisfies a target concentration (406). If the concentration of the chemical product in the use solution satisfies a target concentration (406), the dispenser controller electronically controls a fluid directing device, such as one of fluid directing devices 106, 206, 270, or 314 as described above, or pump/gravity feed/diverter 364 as described with respect to FIG. 7, to direct the recycled fluid from the cleaning apparatus to a sump containing the use solution (408). If the concentration of the chemical product in the use solution does not satisfy the target concentration (406), the dispenser controller electronically controls a fluid directing device, such as one of fluid directing devices 106, 206, 270, or 314 as described above, to direct the recycled fluid from the cleaning apparatus to the dispenser (410). In this way, the recycled fluid is directed to the dispenser, where it is used to dispense the solid chemical product concentrate and form a dispensed solution, which is then directed to the sump to increase the concentration of the chemical product in the use solution. The dispenser controller may continue to monitor the concentration of the use solution (402, 404, 406) throughout the cleaning cycle to increase the concentration of the chemical product in the use solution as necessary during the cleaning cycle.

Although the examples presented herein are described with respect to a dishmachine application, it shall be understood that the dispensing techniques utilizing existing fluid may be applied to a variety of other applications that call for dispensation of a solid block of chemical product. Such applications may include, for example, laundry applications, food processing applications, agricultural applications, cleaning of food processing equipment, hospitality applications, healthcare facilities, and/or any other application in which solid blocks of a chemical product are needed to create use solutions for cleaning, sanitizing, disinfecting, etc.

Those of skill in the art will also readily understand that the disclosure is applicable to dispensation of any type of solid chemical product. For example, depending upon the type of dispenser and the type of solid chemical product to be dispensed, the solid chemical product may be contained within a product capsule, which is loaded into a product capsule receiving reservoir or product holder (tank, tray, hopper, etc.) within the dispenser. In another example, the solid chemical product may be loaded directly into a reservoir of the relevant chemical product dispenser. The chemical product may be a solid concentrate, an extruded solid, a pressed solid, or may take the form of tablets, pellets or other form factor, or may be any other form of chemical product known or will be known to those of skill in the art. In general, the invention is not limited with respect to the form of the solid chemical product and/or the technique by which the existing fluid is applied to the solid chemical product within the dispenser. Rather, it shall be understood that the disclosure relates generally to use of existing fluid to dispense a solid chemical product, regardless of the form of the chemical product or the particular mechanism by which the existing fluid is applied to dispense the solid chemical product.

In some examples, control of a dispenser that uses existing fluid to dispense a solid chemical product may encompass one or more tangible computer-readable media comprising instructions that cause one or more processors to carry out the methods described above. A "computer-readable medium" includes but is not limited to read-only memory (ROM), random access memory (RAM), non-volatile random access memory (NVRAM), electrically erasable programmable read-only memory (EEPROM), flash memory a magnetic hard drive, a magnetic disk or a magnetic tape, a optical disk or magneto-optic disk, a holographic medium, or the like. The instructions may be implemented as one or more software modules, which may be executed by themselves or in combination with other software.

The instructions and the media are not necessarily associated with any particular computer or other apparatus, but may be carried out by various general-purpose or specialized machines. The instructions may be distributed among two or more media and may be executed by two or more machines. The machines may be coupled to one another directly, or may be coupled through a network, such as a local access network (LAN), or a global network such as the Internet.

Control of a dispenser that uses existing fluid to dispense a solid chemical product may also be embodied as one or more devices that include logic circuitry to carry out the functions or methods as described herein. The logic circuitry may include a processor that may be programmable for a general purpose or may be dedicated, such as microcontroller, a microprocessor, a Digital Signal Processor (DSP), an Application Specific Integrated Circuit (ASIC), a field programmable gate array (FPGA), and the like.

One or more of the techniques described herein may be partially or wholly executed in software. For example, a computer-readable medium may store or otherwise comprise computer-readable instructions, i.e., program code that can be executed by a processor to carry out one of more of the techniques described above.

Various examples have been described. These and other examples are within the scope of the following claims.

The invention claimed is:

1. A system comprising:

a chemical product dispenser having a housing sized to receive a chemical product in the form of a solid chemical product concentrate;

a sump;

the housing of the chemical product dispenser further including an inlet by which recycled fluid from a cleaning apparatus enters the housing and an outlet by which a dispensed solution, formed by contact of the recycled fluid with the solid chemical product concentrate, exits the housing and is directed to the sump to form a use solution;

a fluid directing device;

a first fluid delivery conduit connected to deliver the recycled cleaning fluid from the cleaning apparatus to an inlet of the fluid directing device;

a second fluid delivery conduit connected to deliver the recycled cleaning fluid from the fluid directing device to the sump;

a third fluid delivery conduit connected to deliver the recycled cleaning fluid from the fluid directing device to the inlet of the chemical product dispenser; and a controller that determines the concentration of the chemical product in the use solution and electronically controls the fluid directing device to direct the recycled fluid from the cleaning apparatus through the second fluid delivery conduit to the sump if the concentration of the chemical product in the use solution satisfies a target concentration, and to direct the recycled fluid from the cleaning apparatus through the third fluid delivery conduit to the inlet of the chemical product dispenser if the concentration of the chemical product in the use solution does not satisfy the target concentration, such that the recycled fluid contacts the solid chemical product concentrate to form the dispensed solution, the dispensed solution exits the housing and is directed to the sump to increase the concentration of the chemical product in the use solution.

2. The system of claim 1 wherein the cleaning apparatus includes one of a dishmachine or a laundry machine.

3. The system of claim 1 wherein the solid chemical product concentrate includes one of an extruded solid, a pressed solid, tablets, or pellets.

4. The system of claim 1 wherein the solid chemical product concentrate is contained within product capsule sized to be received within the housing of the dispenser.

5. The system of claim 1 wherein the chemical product dispenser dispenses the chemical product directly from the chemical product dispenser.

6. The system of claim 1 wherein the controller further compares the monitored concentration of the chemical product in the use solution with the target concentration and determines whether additional chemical product should be added to the use solution based on the comparison.

7. The system of claim 1 further comprising a sensor communicatively coupled to the controller that monitors a characteristic indicative of the concentration of the chemical product in the use solution.

8. The system of claim 7 wherein the sensor includes one of a conductivity sensor or a pH sensor.

9. A system, comprising:

a cleaning apparatus that receives articles to be washed during a cleaning process;

a sump positioned to capture and hold a use solution comprised of a fluid and a dispensed chemical product;

a sensor that monitors a concentration of the chemical product in the use solution;

a fluid directing device connected to receive recycled fluid from the cleaning apparatus during the cleaning cycle;

a chemical product dispenser sized to receive a solid chemical product concentrate, wherein the chemical product dispenser dispenses the chemical product into the use solution by applying the recycled fluid from the cleaning apparatus to the solid chemical product;

a first fluid delivery conduit connected to deliver the recycled cleaning fluid from the cleaning apparatus to an inlet of the fluid directing device;

a second fluid delivery conduit connected to deliver the recycled cleaning fluid from the fluid directing device to the sump;

a third fluid delivery conduit connected to deliver the recycled cleaning fluid from the fluid directing device to an inlet of the chemical product dispenser;

a dispenser controller that compares the monitored concentration of the chemical product in the use solution with a target concentration, wherein the dispenser controller further electronically controls the fluid directing device to direct the recycled fluid through the second fluid delivery conduit into the use solution in the sump if the monitored concentration of the chemical product in the use solution satisfies the target concentration, and to direct the recycled fluid through the third fluid delivery conduit to the inlet of the chemical product dispenser if the monitored concentration of the chemical product in the use solution does not satisfy the target concentration.

10. The system of claim 9, further including a cleaning apparatus controller communicatively coupled to the dispenser controller.

11. The system of claim 10 wherein the cleaning apparatus controller communicates initiation of a wash phase of the cleaning process to the dispenser controller, and wherein upon initiation of the wash phase the dispenser controller controls dispensation by the chemical product dispenser of one or more chemical products used during the wash phase.

12. The system of claim 10 wherein the cleaning apparatus controller communicates initiation of a rinse phase of the cleaning process to the dispenser controller, and wherein upon initiation of the rinse phase the dispenser controller controls dispensation by the chemical product dispenser of one or more chemical products used during the rinse phase.

13. A system comprising:

a chemical product dispenser having a housing sized to receive a chemical product in the form of a solid chemical product concentrate, the housing further including an inlet by which recycled fluid from a cleaning apparatus enters the housing and an outlet by which a dispensed solution, formed by contact of the recycled fluid with the solid chemical product concentrate, exits the housing and is directed to a sump containing a use solution;

a fluid directing device;

a first fluid delivery conduit connected to deliver the recycled cleaning fluid from the cleaning apparatus to an inlet of the fluid directing device;

a second fluid delivery conduit connected to deliver the recycled cleaning fluid from the fluid directing device to the sump;

a third fluid delivery conduit connected to deliver the recycled cleaning fluid from the fluid directing device to an inlet of the chemical product dispenser; and a controller that determines the concentration of the chemical product in the use solution and electronically controls the fluid directing device to direct the recycled fluid through the second fluid delivery conduit to the sump if the concentration of the chemical product in the use solution satisfies a target concentration, and to direct the recycled fluid through the third fluid delivery conduit to the inlet of the dispenser if the concentration of the chemical product in the use solution does not satisfy the target concentration, such that the recycled fluid contacts the solid chemical product concentrate to form the dispensed solution, the dispensed solution exits the housing and is directed to the sump to increase the concentration of the chemical product in the use solution.

14. The system of claim 13 wherein the recycled fluid is recycled wash or recycled rinse fluid from a cleaning apparatus.

15. The system of claim 13 wherein the recycled fluid is use solution from the sump.

16. The system of claim 13 wherein the chemical product dispenser forms the dispensed solution by spraying the recycled fluid onto the solid chemical product concentrate.

17. The system of claim 13 wherein the chemical product dispenser forms the dispensed solution by flooding the solid chemical product concentrate with the recycled fluid.

18. The system of claim 13 wherein the chemical product dispenser forms the dispensed solution by immersing the solid chemical product concentrate in a pool of the recycled fluid.

* * * * *